US005691495A

United States Patent [19]

Fujimori

[11] Patent Number: 5,691,495

[45] Date of Patent: Nov. 25, 1997

[54] ELECTRONIC MUSICAL INSTRUMENT WITH SYNCHRONIZED CONTROL ON GENERATION OF MUSICAL TONES

[75] Inventor: Junichi Fujimori, Hamamatsu, Japan

[73] Assignee: Yamaha Corporation, Japan

[21] Appl. No.: 490,805

[22] Filed: Jun. 15, 1995

[30] Foreign Application Priority Data

Jun. 17, 1994 [JP] Japan ..... 6-158235

[51] Int. Cl.[6] ..... G10H 1/22; G10H 7/00

[52] U.S. Cl. ..... 84/618; 84/645

[58] Field of Search ..... 84/609, 618, 615, 84/645, 653, 656

[56] References Cited

U.S. PATENT DOCUMENTS

| | | | |
|---|---|---|---|
| 4,543,869 | 10/1985 | Kawashima et al. . | |
| 4,922,796 | 5/1990 | Kondo et al. | 84/618 |
| 5,206,446 | 4/1993 | Matsumoto et al. | 84/615 X |
| 5,278,349 | 1/1994 | Mutoh et al. . | |
| 5,410,099 | 4/1995 | Kosugi | 84/618 |
| 5,446,237 | 8/1995 | Abe et al. | 84/602 X |
| 5,539,145 | 7/1996 | Kuribayashi | 84/645 X |

*Primary Examiner*—William M. Shoop, Jr.
*Assistant Examiner*—Jeffrey W. Donels
*Attorney, Agent, or Firm*—Graham & James LLP

[57] ABSTRACT

An electronic musical instrument comprises a sequencer which acts as an automatic performance apparatus, so the sequencer provides automatic performance data in a MIDI-standard form. Upon receipt of MIDI data from the sequencer, the electronic musical instrument generates musical tones automatically. In a normal tone-generation mode, the musical tones are sequentially and automatically generated at appropriate timings. A sync-tone-generation mode is further provided to perform sync tone-generation. The sync-tone-generation mode is activated by indicator data (or delimiter code) which are transmitted together with specific MIDI data corresponding to musical tones which should be subjected to sync tone-generation. Each MIDI data normally consists of one status byte and two data bytes, while a running status function is employed in the sync-tone-generation mode so that the specific MIDI data are transmitted with omitting a status byte (or status bytes). In the sync-tone-generation mode, sync generation of the musical tones is set in a standby state until preparation thereof is completed. The standby state is sustained until preparation for sync tone-generation is completed with respect to substantially all of the musical tones regarding the sync tone-generation. Thus, optimum sync tone-generation for the musical tones is secured.

5 Claims, 13 Drawing Sheets

SEQUENCE DATA

ELECTRONIC MUSICAL INSTRUMENT WITH SYNCHRONIZED CONTROL ON GENERATION OF MUSICAL TONES

BACKGROUND OF THE INVENTION

1. Field of the Invention

The present invention relates to electronic musical instruments, and more particularly to ones which perform synchronized control on generation of musical tones.

2. Prior Art

Automatic performance apparatuses conventionally known employ sequencers to store performance information, so the performance information is reproduced and is supplied to electronic musical instruments which generate musical tones based on the performance information reproduced. Thus, automatic performance of music is played. Each of the automatic performance apparatuses employing the sequencers is capable of regenerating musical performance, which is given by a player who actually plays a musical instrument, with great fidelity. In addition, those apparatuses are used to provide special musical performance which cannot be manually played by the player.

In the musical performance manually played, shifts occur among tone-generation timings of constituent notes of a chord, although the constituents notes should be generated simultaneously. In ensemble performance using multiple electronic musical instruments, the shifts may become large due to differences between tone-generation timings of individual players. When one player performs a musical instrument, there is a limit in a number of simultaneous manual operations to the musical instrument, so a number of musical tones simultaneously generated should be limited. In addition, it is not possible to simultaneously generate musical tones corresponding to manual-operable members (e.g., keys, pedals and the like) which positions are apart from each other so that one player cannot depress simultaneously. In other words, another limitation exists in simultaneous generation of the musical tones whose pitches are greatly different from each other. Meanwhile, the automatic performance apparatus employing the sequencer can solve some of the problems described above.

In general, some automatic performance apparatus conventionally known is designed in such a way that performance information should be transferred to the electronic musical instrument serially. So, after completely receiving a plurality of performance information representative of musical tones which should be generated simultaneously, the electronic musical instrument conducts tone-generation process. This may cause a small shift in tone-generation timings. Normally, automatic performance, which is made using the automatic performance apparatus, is provided to realize a so-called "inorganic" performance by making a strict matching among tone-generation timings. In that automatic performance, it is not possible to overlook even a small shift between tone-generation timings. In some cases, the automatic performance apparatus is specialized to generate a plenty of musical tones simultaneously. Herein, a "length" of one pair of performance information to be transferred (in other words, a total 'data length' corresponding to one pair of performance data to be transferred) becomes long as compared to the musical performance manually played. This may emphasize shifts between tone-generation timings.

SUMMARY OF THE INVENTION

It is an object of the present invention to provide an electronic musical instrument which perform synchronized control on generation of musical tones without substantially causing shifts between tone-generation timings even if a number of the musical tones simultaneously generated is relatively large.

An electronic musical instrument, according to the present invention, comprises a sequencer which acts as an automatic performance apparatus, so the sequencer provides automatic performance data in a MIDI-standard form. Upon receipt of MIDI data from the sequencer, the electronic musical instrument generates musical tones automatically. In a normal tone-generation mode, musical tones are sequentially and automatically generated at appropriate timings. A sync-tone-generation mode is further provided to perform sync tone-generation. The sync-tone-generation mode is activated by indicator data (or delimiter code) which are transmitted together with specific MIDI data corresponding to musical tones which should be subjected to sync tone-generation.

Each MIDI data normally consists of one status byte and two data bytes, while a running status function is employed in the sync-tone-generation mode so that the specific MIDI data are transmitted with omitting a status byte (or status bytes). In the sync-tone-generation mode, sync generation of the musical tones is set in a standby state until preparation thereof is completed. The standby state is sustained until preparation for sync tone-generation is completed with respect to substantially all of the musical tones regarding the sync tone-generation. Even if a truncate process, which takes relatively long time, is requested by one of the musical tones, the standby state is sustained until completion of the truncate process. Thus, optimum sync generation for the musical tones can be secured.

BRIEF DESCRIPTION OF THE DRAWINGS

These and other objects of the subject invention will become more fully apparent as the following description is read in light of the attached drawings wherein.

DESCRIPTION OF THE PREFERRED EMBODIMENT

Figure 1:
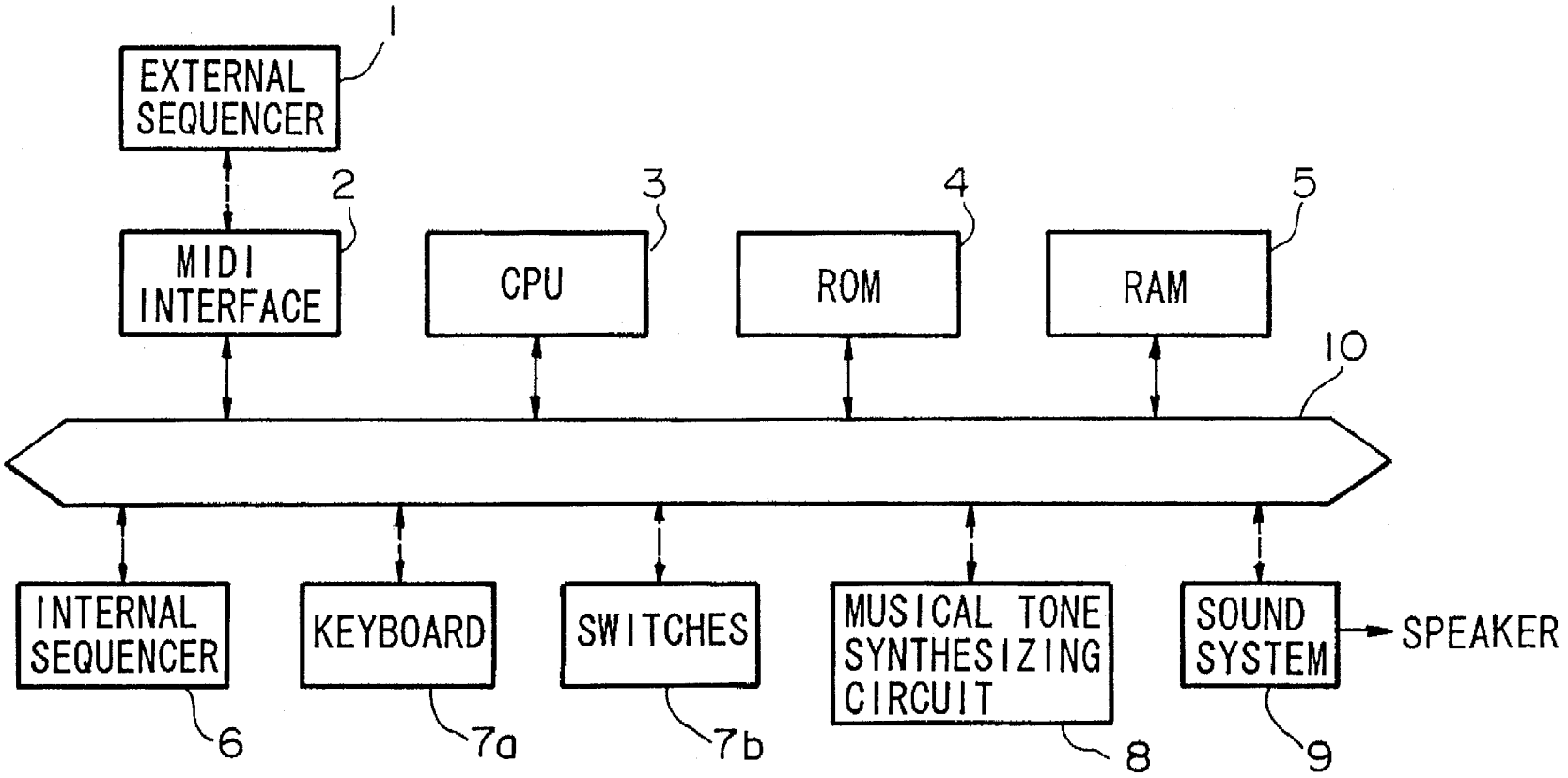
FIG. 1 is a block diagram showing detailed configuration of an electronic musical instrument, containing function of an automatic performance apparatus, according to an embodiment of the present invention.

Now, a preferred embodiment of the present invention will be described with reference to the drawings. FIG. 1 is a block diagram showing an overall configuration of an electronic musical instrument according to an embodiment of the present invention. Herein, an external sequencer 1 or an internal sequencer 5 acts as an automatic performance apparatus which is connected with a main body of the electronic musical instrument with MIDI codes (where 'MIDI' is an abbreviation for 'Musical Instrument Digital Interface').

The external sequencer 1 provides memories or the same which store automatic performance data inputted thereto, so the automatic performance data read out are transferred to the main body of the electronic musical instrument by using a data format based on MIDI standard (hereinafter, simply referred to as a 'MIDI-standard format'). A MIDI interface, provided in the main body of the electronic musical instrument, is provided to receive the automatic performance data, based on the MIDI standard, which are transferred thereto from the external sequencer 1. A central processing unit (CPU) 8 controls electronic parts of the electronic musical instrument. There are provided two modes, i.e, an automatic performance mode and a manual performance mode. The automatic performance mode is activated when receiving the automatic performance data, so the automatic performance data received are transferred to a musical tone synthesizing circuit 8 through a bus line 10. Thus, sounds for automatic performance are generated by the electronic musical instrument. On the other hand, when the manual performance mode is designated, manual performance data, which are produced responsive to manual operations to manual-operable members such as keys of a keyboard, are supplied to the musical tone synthesizing circuit 8 through the bus line 10. Thus, sounds for manual performance are generated.

A read-only memory (ROM) 4 stores 'preset' tone-color data as well as programs, wherein the preset tone-color data are preset in advance, while the programs are executed by the CPU 3. A random-access memory (RAM) 5 is used as 8 work memory for the CPU 3 and is also used as a storage which stores 'custom' tone-color data which are set by a user. The internal sequencer 6 has functions which are similar to those of the external sequencer. The internal sequencer 6 is built in the electronic musical instrument. A keyboard 7*a* consists of keys which are manually operated by a player. Switches 7*b* contain tone-color selecting switches, tempo setting switches and the like. The musical tone synthesizing circuit 8 produces musical tone signals, representative of musical tones synthesized, based on performance data supplied thereto. A sound system 9 amplifies the musical tone signals of the musical tone synthesizing circuit 8 so as to generate corresponding musical tones by speakers.

As described above, the electronic musical instrument comprises functional blocks 2 to 9. When the internal sequencer 6 is not provided in the electronic musical instrument, the external sequencer 1 is connected with the main body of the electronic musical instrument.

Figure 2A:
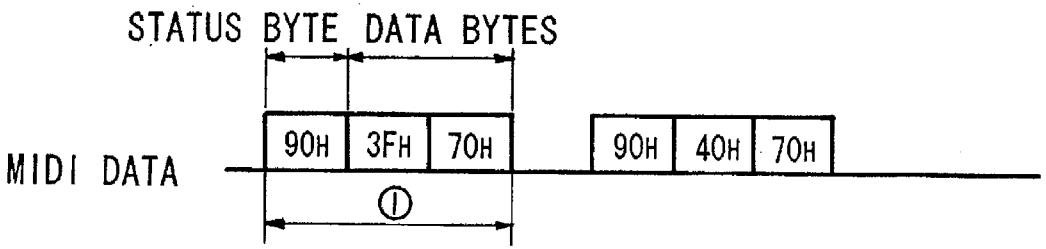
FIGS. 2A and 2B are time charts showing transmission of MIDI data in connection with a sync signal.
Figure 2B:
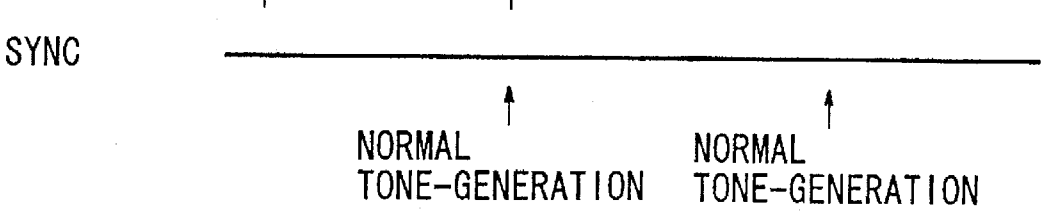
Figure 2C:
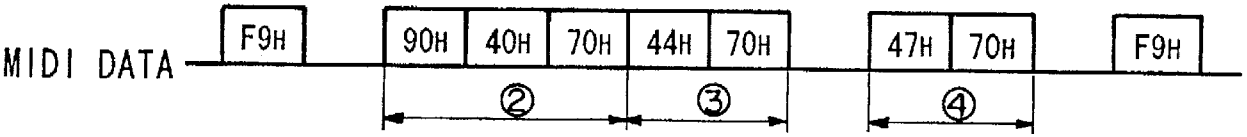
FIGS. 2C and 2D are time charts showing transmission of MIDI data in connection with a sync signal.
Figure 2D:
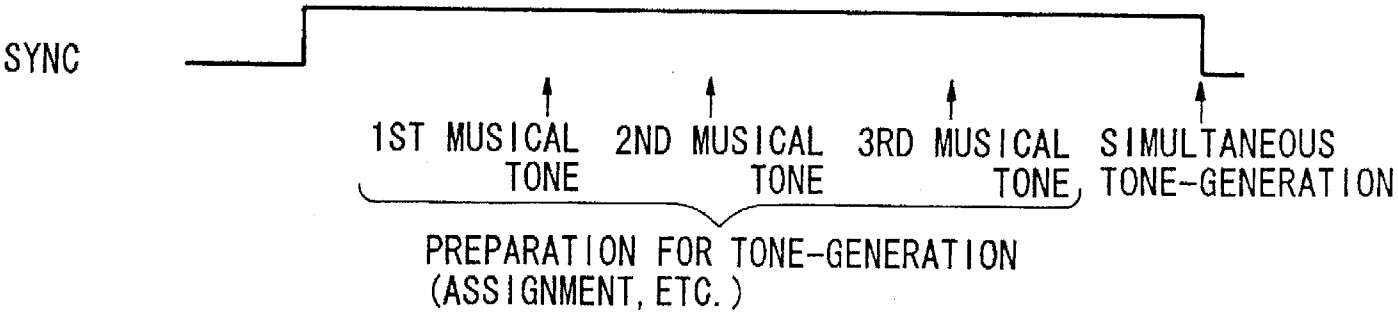

Now, FIGS. 2A and 2D are used to explain the MIDI-standard format for the automatic performance data to be transferred from the external sequencer 1 or the internal sequencer 6 as well as tone-generation timings in a sync-tone-generation mode.

As shown in FIG. 2A, performance data in the MIDI-standard format consists of one status byte and two data bytes. For example, the status byte at '90H' indicates a note-on event which occurs on a MIDI channel 0; a first data byte at '3FH' indicates a pitch; and a second data byte at '70H' indicates velocity, i.e., tone volume. Thus, the performance data, consisting of three bytes which are respectively at '90H', '3FH' and '70H', indicate a tone-generation event in which a musical tone is generated using the pitch of '3FH' in the tone volume of '70H' by the MIDI channel 0. The musical tone is actually generated by the speaker after the three bytes of the performance data are completely received by the electronic musical instrument. This is called a normal tone-generation mode.

Next, performance data, consisting of three bytes which are respectively at '90H', '40H' and '70H', is transferred to the electronic musical instrument; and consequently, the electronic musical instrument conducts a normal tone-generation to generate a musical tone using a pitch of '40H' in a tone volume of '70H' by the MIDI channel 0 after completely receiving those three bytes of the performance data.

Next, in FIG. 2C, when the electronic musical instrument receives a signal (or indicator data) which is at 'F9H', the normal tone-generation mode is switched over to the sync-tone-generation mode. The sync-tone-generation mode is sustained in a duration existing between first and second signals each of which is at 'F9H'. Thus, performance data, which are transferred to the electronic musical instrument in that duration, are subjected to sync tone-generation, so musical tones corresponding to the performance data are simultaneously generated at a timing corresponding to a moment when the electronic musical instrument receives the second signal of 'F9H'.

After receipt of the first signal of 'F9H', a sync signal (i.e., 'SYNC' in FIG. 2D) is activated so that a level thereof is changed to a high level. Thereafter, the sync signal SYNC is fallen down in level after receipt of the second signal of 'F9H'. In a high-level duration of the sync signal SYNC in FIG. 2D, multiple performance data representative of three musical tones are sequentially transferred in the MIDI-standard format. Herein, a first musical tone corresponds to performance data consisting of three bytes which are respectively represented by '9OH', '40H' and '70H'; a second musical tone corresponds to performance data consisting of two bytes which are respectively represented by '44H' and '70H'; and a third musical tone corresponds to performance data consisting of two bytes which are respectively represented by '47H' and '70H'. Based on three performance data, preparation for tone generation, such as channel assignment, is made. At receipt of the second signal of 'F9H', the three musical tones are simultaneously generated. By the way, data based on the MIDI-standard format (hereinafter, simply referred to as 'MIDI data') basically comprise the status byte and data bytes. However, some commands, regarding the MIDI data, do not require the data byte. In the status byte, a most significant bit (shortened as 'MSB') should be certainly set at '1'. In contrast, a MSB of the data byte should be certainly set at '0'. Therefore, it is possible to certainly distinguish the status byte and data byte, regardless of a form of the MIDI data. Meanwhile, a so-called "running status function" is employed for the first to third musical tones. The running status function is provided to reduce data-transfer capacity. In the running status function, a receiving side is designed to normally store a status byte which the receiving side receives lastly, so all of data bytes sequentially received are interpreted based on the status byte stored. In the second and third musical tones, a status byte is omitted because it is identical to the status byte of the first musical tone. In other words, as for the second and third musical tones, transfer of the status byte can be omitted. The status byte of the first musical tone is at '90H' which indicates a note-on event (or a key-on event) 'KON' After transfer of the first musical tone having the status byte representing the note-on event, the data bytes of the second and third musical tones are interpreted as ones which relate to the note-on event.

Figure 3:
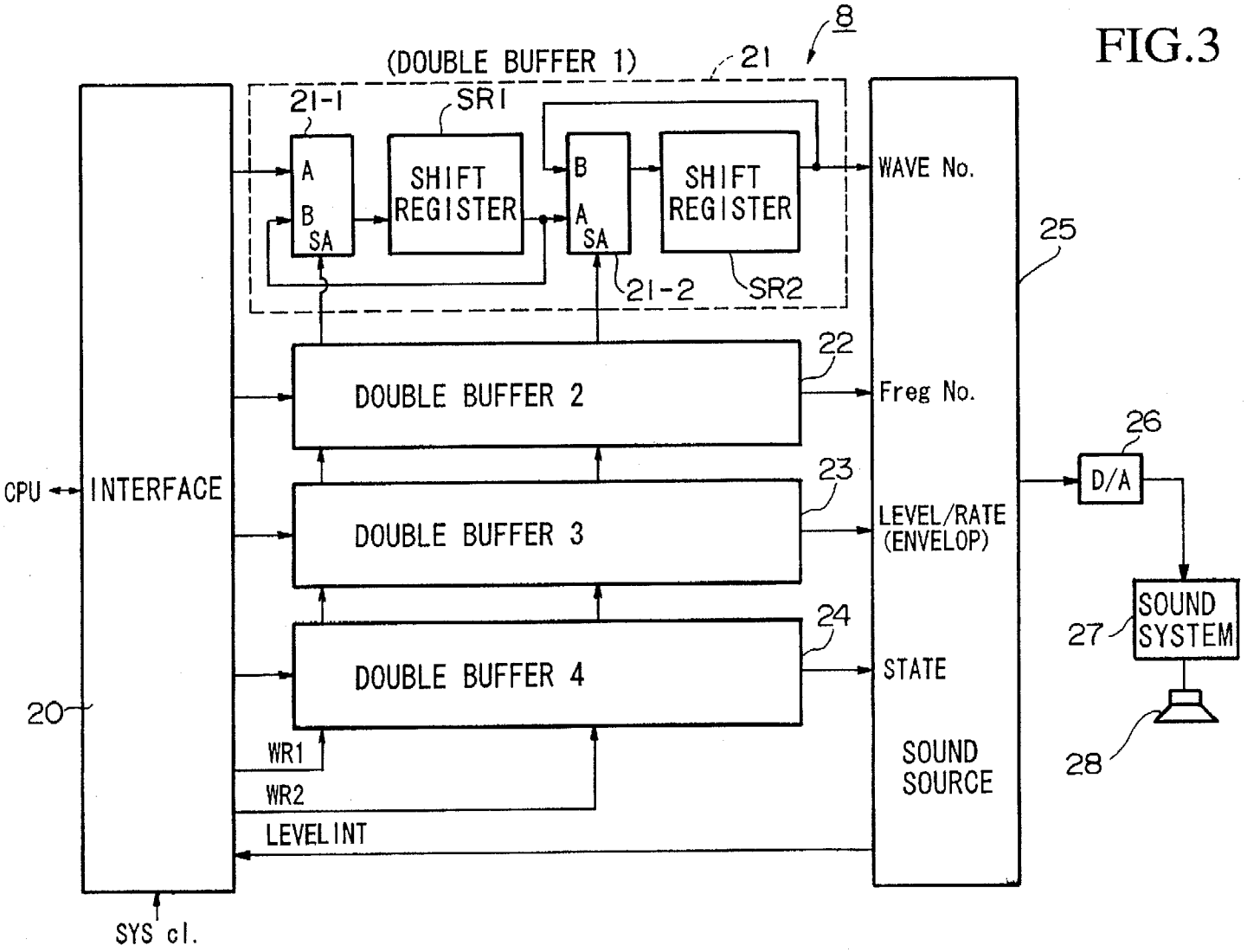
FIG. 3 is a block diagram showing detailed configuration of a musical tone synthesizing circuit shown in FIG. 1.

Next, detailed configuration of the musical tone synthesizing circuit 8 will be described with reference to FIG. 3. As a part of the musical tone synthesizing circuit 8, there is provided a sound source 25 which is designed to synthesize musical tones based on waveform numbers (WAVE No.), frequency information (Freq. No.), envelope information (LEVEL/RATE) and state information (STATE), wherein the envelope information represents key-on events, key-off events, states of envelope and the like. At first, an interface 20 receives a tone-generation request for a certain musical tone from the CPU 3. When system clocks (SYS cl.), which synchronize with a tone-generation channel designated, meet timings of a desired tone-generation channel, the interface 20 produces a waveform number based on tone-color information, so the waveform number is transferred to a double buffer 21 in accordance with the system clocks. In addition, it produces frequency information based on pitch information, so the frequency information is transferred to a double buffer 22. Further, it produces envelope information based on tone-volume information, so the envelope information is transferred to a double buffer 23. Furthermore, it produces state information based on the status byte, so the state information is transferred to a double buffer 24. Each of the double buffers 21 to 24 is configured using two shift registers respectively denoted by numerals 'SR1' and 'SR2'. Those shift registers SR1 and SR2 are connected together in a cascade-connection manner. Four shift registers SR2, provided respectively in four double buffers 21 to 24, output four data to the sound source 25, wherein the four data represent the waveform number, frequency information, envelope information and state information as described above. The sound source 25 synthesizes a musical tone based on the four data, so a digital signal representative of the musical tone is transferred to a digital-analog converter 26 in which it is converted into an analog signal. The analog signal is transmitted to a speaker 28 through a sound system 27. Thus, the musical tone is generated by the speaker 28.

Figures 4A, 4B, 4C:
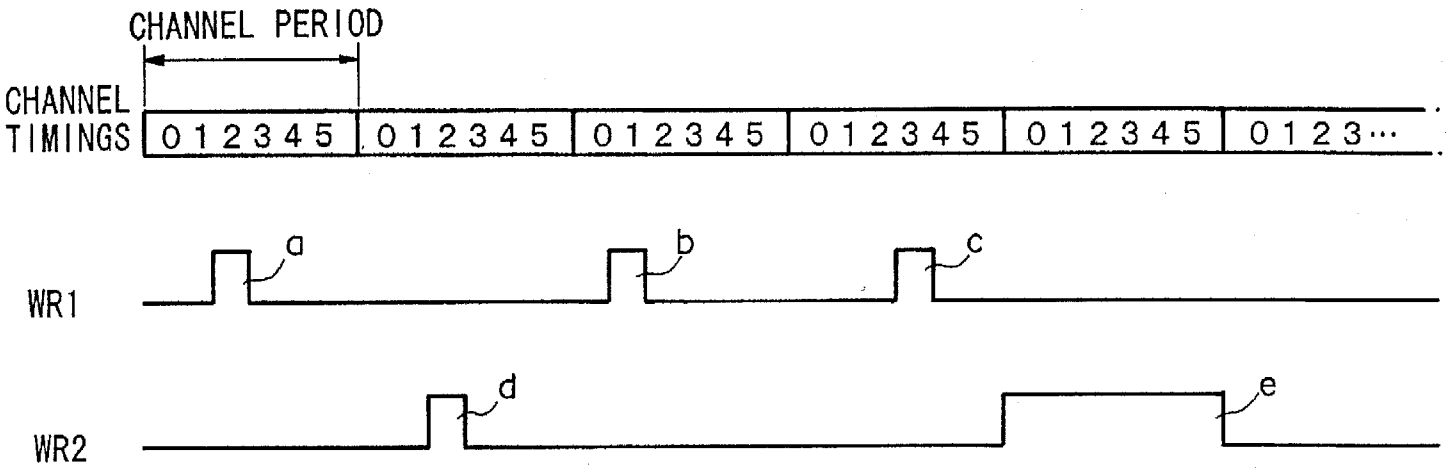
FIGS. 4A, 4B and 4C are time charts showing relationship between circulation of channel timings and clock signals.

Next, operations of the double buffers 21 to 24 will be described with reference to a time chart of FIG. 4. The time chart of FIG. 4 is made based on an assumption where the sound source 25 provides six tone-generation channels '0' to '5' which operate in a time-division manner. Time-division operations of the channels are indicated by channel timings 0 to 5 in FIG. 4. Hereinafter, a channel timing 'n' (where $0 \leqq n \leqq 5$) will be called a "channel-n timing". A set of the channel timings 0 to 5 are repeated by every 'channel period'. First and second clock signals 'WR1' and 'WR2', shown in FIG. 4, are applied to the double buffers 21 to 24. In FIG. 4, a pulse 'a' of the first clock signal WR1 occurs at a channel-2 timing in a first channel period, so channel-2 data are inputted to the double buffers 21 to 24. Inputting of the channel-2 data will be described in detail by referring to an internal configuration of the double buffer 21 in FIG. 3.

When the pulse 'a' of the first clock signal WR1 is applied to a control terminal SA of a first selector 21-1 in the double buffer 21, the first selector 21-1 selects an input terminal A thereof, to which waveform-number data are supplied from the interface 20. Thus, the shift register SR1 rewrites the waveform-number data of a channel-2. The shift register SR1 is configured in such a way that data of channels can be accumulated. If a pulse of the first clock signal WR1 does not arrive at the first selector 21-1 although waveform-number data of a certain channel are outputted from the shift register SR1 and are supplied to an input terminal B of the first selector 21-1, the first selector 21-1 selects the input terminal B thereof so that waveform-number data, which are accumulated by the shift register SR1, are written into the shift register SR1 again. In short, it can be apparently observed that the same waveform-number data are retained by the shift register SR1.

At a channel-2 timing of a next channel period, a pulse 'd' of the second clock signal WR2 arrives at a control terminal SA of a second selector 21-2. At that timing, the second selector 21-2 selects an input terminal A thereof, to which a waveform-number signal from the shift register SR1 is supplied. Thus, waveform-number data of a channel-2, which are retained by the shift register SR2, are rewritten. Incidentally, the second selector 21-2 normally selects an input terminal B thereof at other channel timings, other than the channel-2 timing, in which the pulse 'd' of the second clock signal WR2 is not applied to the second selector 21-2. At the other channel timings, waveform-number data, outputted from the shift register 21-2, are repeatedly written into the shift register SR2 through the second selector 21-2. Therefore, it can be apparently observed that the waveform data for other channels, other than the channel-2, are retained by the shift register SR2.

All of the double buffers 21 to 24 have same configuration. So, in accordance with the pulse 'a' of the first clock signal WR1 and the pulse 'd' of the second clock signal WR2, performance data of the channel-2 are rewritten in the double buffers 21 to 24.

In accordance with a pulse 'b' of the first clock signal WR1 in FIG. 4, performance data of a channel-1 are rewritten in the shift register SR1. In accordance with a pulse 'c' of the first clock signal WR1, performance data of a channel-3 are rewritten in the shift register SR1. A pulse 'e' of the second clock signal WR2 has a large pulse width which corresponds to all of the channel timings 0 to 5 in one channel period. This pulse 'e' is applied to the second shift register SR2, so performance data of all channels are rewritten in the shift register SR2. As for channels other than a channel-1 and a channel-3 in one channel period, data outputted from the shift register SR1 are remained same. Thus, only performance data of the channel-1 and channel-3 are substantially rewritten in the shift register SR2.

As described above, performance data in the double buffers 21 to 24 are rewritten by new performance data; and consequently, new musical tones are produced by the sound source 25.

Pulses of the first clock signal WR1 are used to rewrite performance data of specific channels in advance; and then, a special pulse (like the pulse 'e') of the second clock signal WR2 is used to simultaneously transfer performance data of all channels to the sound source 25. Thus, it is possible to simultaneously generate multiple musical tones, some of which are rewritten in contents by the first clock signal WR1 in advance.

In formation of an envelope, a shape of the envelope is designated by a target value (LEVEL) and an inclination (RATE). Values of the envelope are added together in synchronization with system clocks with respect to each of the channels independently. When result of addition reaches the target value, the sound source 25 produces a level interrupt signal (LEVEL INT), which is sent to the interface 20 so as to report that the envelope of a specific channel coincides with the target value. Upon receipt of the level interrupt signal, the interface 20 transmits new envelope information (LEVEL/RATE) and changes the state information (STATE).

The formation of the envelope is progressed with respect to each of the channels independently. Thus, rewriting of values of the envelope is made at timings, corresponding to small pulses (e.g., 'a' and 'b') of the first and second clock signals WR1 and WR2, at which performance data of each channel are rewritten.

Process for rewriting envelope information and state of a specific channel by the level interrupt signal (LEVEL INT) is set lower in degree of priority than a data-rewrite request from the CPU 3. When a first instruction to rewrite data for sync tone-generation by the CPU 3 and a second instruction to rewrite information by the level interrupt signal are simultaneously supplied to the interface 20, only the first instruction by the CPU 3 is executed. For example, when a certain channel receives a 'KOFF' instruction from the CPU 3 as well as the level interrupt signal, normal progression of envelope state is ignored and the system proceeds to formation of a key-on envelope. Herein, control on the degree of priority is made by the interface 20.

The double buffer 21 to 24 are provided to temporarily retain a plurality of data which are transmitted thereto by different timings, so musical tones corresponding to the plurality of data can be generated simultaneously at a same timing.

Figure 5:
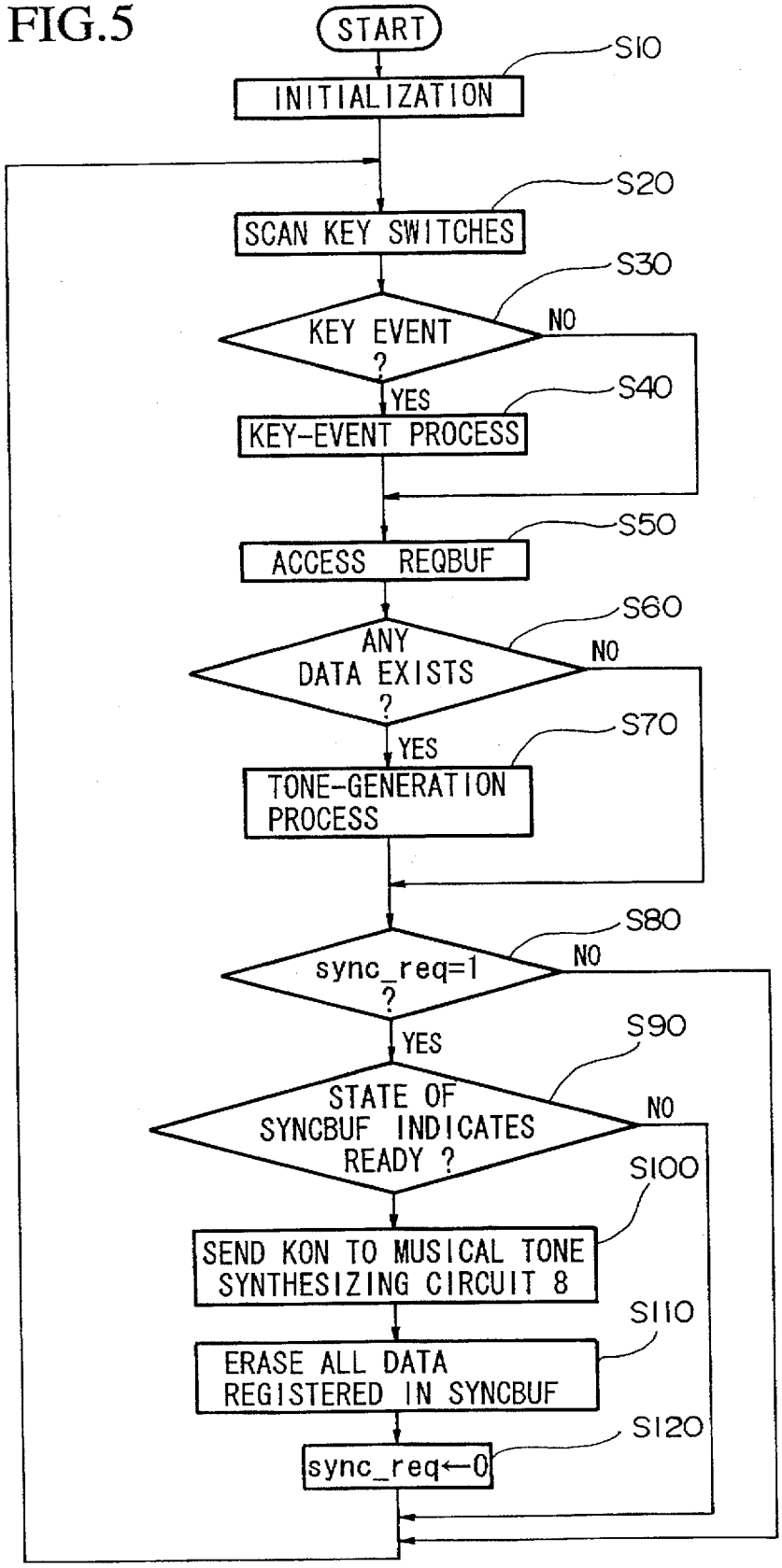
FIG. 5 is a flowchart showing a main routine which is executed by a CPU provided in the electronic musical instrument of FIG. 1.

FIG. 5 shows a main routine which is executed by the CPU 3 of the electronic musical instrument. In first step S10, initialization is made responsive to a power-on event, so registers and the like are cleared. In step S20, the CPU 3 scans key switches. In step S30, decision is made as to whether or not a key event is detected. If the key event is detected, the CPU 3 proceeds to step S40 in which key event process is carried out so that data representative of the key event detected are written into a buffer 'REQBUF'. Next, the CPU 3 proceeds to step S50, which is also activated when the step S30 determines that no key event is detected. In the step S50, the CPU 3 accesses to the buffer REQBUF. In step S60, decision is made as to whether or not any data exist in the buffer REQBUF. If the step S60 detects existence of the data in the buffer REQBUF, the CPU 3 proceeds to step S70 in which tone-generation process is carried out. Incidentally, the data are written into the buffer REQBUF in response to a MIDI event, which will be described later.

Thereafter, the CPU 3 proceeds to step S80, which is also activated when the step S60 determines that no data exists in the buffer REQBUF. In the step S80, decision is made as to whether or not a sync request signal (represented by 'sync_req') is set at '1'. The sync request signal is set at '1' upon receipt of the second signal of 'F9H'. When the step S80 determines that the sync request signal is set at '1', the CPU 3 proceeds to step S90. In the step S90, decision is made as to whether or not information, representative of a state of a buffer SYNCBUF, indicates 'READY' which indicates that preparation has been completed. When 'READY' stands for the buffer SYNCBUF, it is declared that preparation for sync-tone-generation information is completed; in other words, all of channels, regarding performance information which should be subjected to sync tone-generation, are ready to generate musical tones. Thus, in step S100, key-on information (KON) is sent to the musical tone synthesizing circuit 8, so tone-generation is made based on the sync-tone-generation information. In next step S110, all of data registered by the buffer SYNCBUF are erased. In step S120, the sync request signal is set at '0', so a standby state is established, which waits for a next sync-tone-generation information to come. Thereafter, the CPU 3 proceeds back to the step S20, which is also activated when the step S80 determines that the sync request signal is not set at '1' as well as when the step S90 determines that the state of the buffer SYNCBUF does not correspond to 'READY'. Thus, the main routine is repeated.

Figure 6:
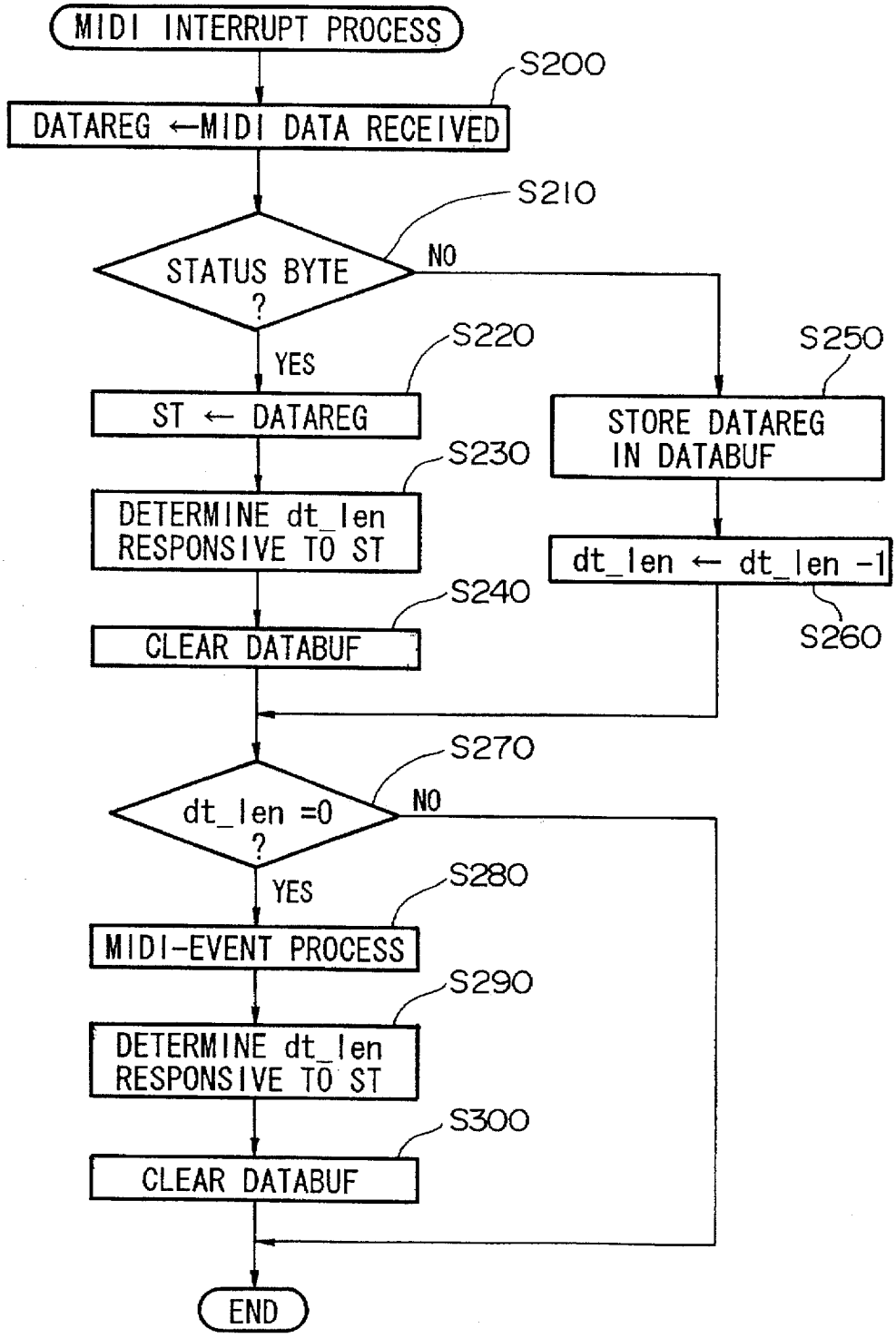
FIG. 6 is a flowchart showing a MIDI interrupt process.

Next, FIG. 6 shows MIDI interrupt process which is activated upon receipt of MIDI data.

In first step S200, MIDI data received are set in a register 'DATAREG'. In step S210, decision is made as to whether or not the MIDI data received correspond to a status byte by examining a MSB thereof. If the status byte is detected, the CPU 3 proceeds to step S220 in which the status byte set in the register DATAREG is represented by numeral 'ST'. In step S230, a data-byte length (represented by "dr_len") is determined responsive to the status byte ST. Determination of the data-byte length is required because in the MIDI standard, a data-byte length required depends upon a status. This is because of a nature of the MIDI standard, wherein a note-on event or a note-off event requires two data bytes; a program-change event requires only one data byte; and some events in the MIDI standard do not require the data byte.

In step 8240, a buffer 'DATABUF' is cleared. If the step S210 does not decide that the MIDI data correspond to the status byte, in other words, if the MIDI data correspond to a data byte (or data bytes), the CPU 3 proceeds to step S250. In the step S250, the MIDI data retained by the register DATAREG are stored by the buffer DATABUF. In step S260, one byte is subtracted from the data-byte length, so result of subtraction is set as a new data-byte length. This is because in the step S250, the buffer DATABUF is designed to store each one byte of the data bytes.

After completion of the step S240 or the step S260, the CPU 3 proceeds to step S270 in which decision is made as to whether or not the data-byte length is zero. If the data-byte length is zero, the CPU 3 determines that inputting of all of necessary data in one performance data is completed. So, the CPU 3 proceeds to step S280 in which MIDI-event process is carried out.

In step S290, a data-byte length is determined responsive to the status byte ST again. Reasons why the data-byte length is set again in step S290 are as follows:

The step S290 is provided to cope with running status function of MIDI data. In case of the running status function, data are consecutively transmitted without status bytes. So, after receiving consecutive data, the step S210 judges that received data do not correspond to status bytes but data bytes. If the running status function is not employed, the data-byte length which is set by the step S290 must be rewritten by the step S230 which is executed with respect to next MIDI data.

In step S300, the buffer DATABUF is cleared. Thereafter, execution of the MIDI interrupt process is completed. Thus, the data byte (or data bytes) which is interpreted as a MIDI event is erased from the buffer DATABUF.

Figure 7:
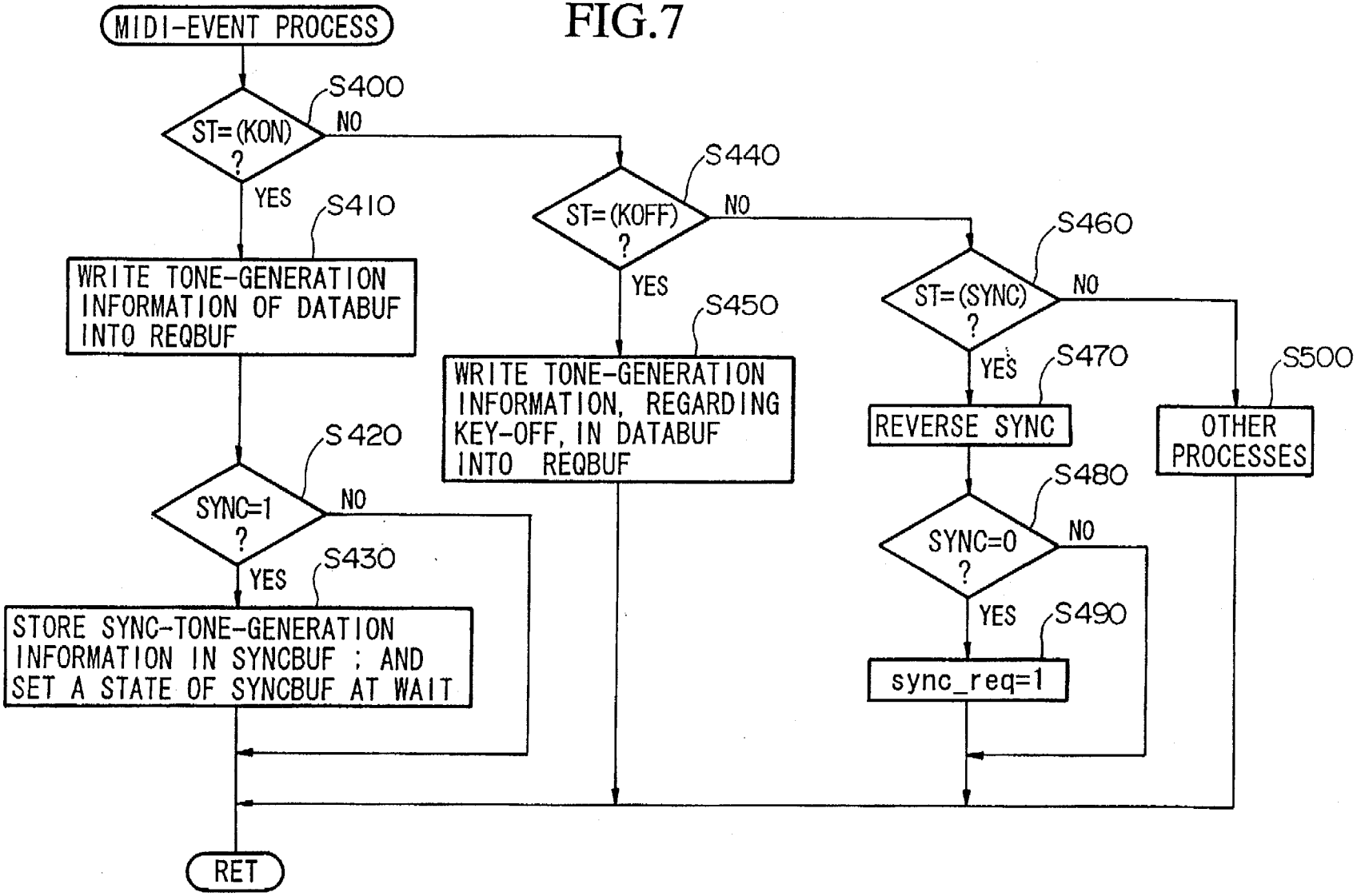
FIG. 7 is a flowchart showing a MIDI-event process.
Figures 8A, 8B, 8C, 8D:
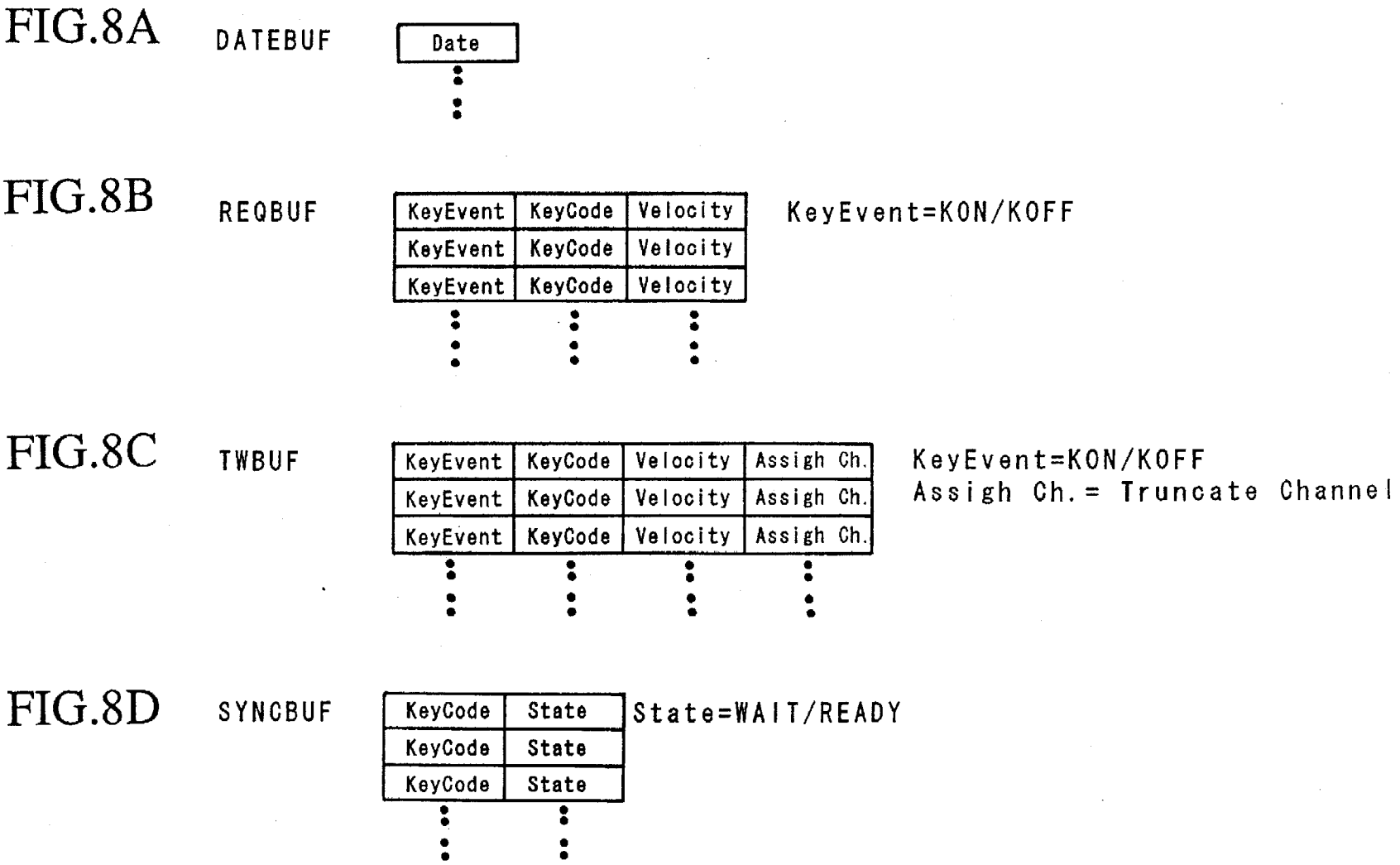
FIGS. 8A, 8B, 8C an 8D show contents of buffers used by the embodiment.

Next, FIG. 7 is a flowchart showing the MIDI-event process. In first step S400, decision is made as to whether or not the status byte ST corresponds to 'KON' (i.e., key-on process). If so, the CPU 3 proceeds to step S410 in which tone-generation information (i.e., data of two bytes representative of a keycode and a velocity), stored by the buffer DATABUF, is written into the buffer REQBUF. In step S420, decision is made as to whether or not the sync signal SYNC is at '1'. When the sync signal SYNC is at '1', the sync-tone-generation mode is selected. So, the CPU 3 proceeds to step S480 in which keycodes in sync-tone-generation information are stored by the buffer SYNCBUF. In addition, a state of the buffer SYNCBUF is represented by 'WAIT' which indicates a waiting state. This WAIT is replaced by the READY, indicating completion of preparation, when assignment of a tone-generation channel is made. After completion of the step S430, execution of the MIDI-event process is ended. When the step S420 determines that the sync signal SYNC is not at '1', it can be said that the sync-tone-generation mode is not selected, so the execution of the MIDI-event process is ended.

When the step S400 determines that the status byte ST does not correspond to the KON, the CPU 3 proceeds to step S440 in which decision is made as to whether or not the status byte ST corresponds to 'KOFF' (i.e., key-off process). If the KOFF is detected, the CPU 3 proceeds to step S450 in which tone-generation information, regarding the key-off process, in the buffer DATABUF is written into the buffer REQBUF. Then, execution of the MIDI-event process is ended. As described above, strictly simultaneous control is not made in the key-off process, which is different from the key-on process. Reasons why the simultaneous control is not made in the key-off process are as follows:

Even if the simultaneous control is not made in the key-off process, generation of musical tones, corresponding to the key-off process, is continued for a while with being decayed. So, it is difficult for a person to distinguish whether or not the musical tones are simultaneously subjected to key-off process. In other words, the simultaneous control is meaningless in the key-off process.

When the step S440 determines that the status byte ST does not correspond to the KOFF, the CPU 3 proceeds to step S460 in which decision is made as to whether or not the status byte ST is at 'F9H' (SYNC). If the 'F9' is detected, the CPU 3 proceeds to step S470 in which the sync signal SYNC is reversed in level so that a tone-generation mode is changed over. In step S480, decision is made as to whether or not the sync signal SYNC is at '0'. If so, the CPU 3 proceeds to step S490 in which the sync request signal (represented by 'sync_req') is set at '1'. After completion of the step S490, execution of the MIDI-event process is ended. When the step S490 is carried out, the steps, which start from the step S90 in FIG. 5, are made valid.

After complete receipt of performance data which should be subjected to sync tone-generation, the sync request is set at '1'. Actually, however, if no idle channel exists, truncate process should be performed on a certain channel which is occupied in generating a musical tone; therefore, after completion of the truncate process, an instruction to start sync tone-generation can be made. This is because an idle channel does not necessarily exist all the time. So, if a small shift, in sync tone-generation, due to execution of the truncate process can be allowed, it is possible to wait for an event, in which the sync request is set at '1', and to make the instruction to start the sync tone-generation.

If the step S460 determines that the status byte ST does not correspond to 'F9H', the CPU 3 proceeds to step S500 in which other processes, relating to the MIDI-event process, are carried out. Thereafter, execution of the MIDI-event process is ended.

FIGS. 8A to 8D show data stored by buffers DATABUF, REQBUF, TWBUF and SYNCBUF. The buffer DATABUF stores data of the register DATAREG, so the data are read from the buffer DATABUF. Data are registered by the buffer REQBUF at completion of the MIDI event; and the data are sequentially read from the buffer REQBUF one by one so that tone-generation process is performed. Herein, completion of the MIDI event indicates a timing at which the system has received a complete set of data bytes corresponding to a status byte of the MIDI event. This buffer REQBUF stores three kinds of data representative of a key event (represented by 'KeyEvent') such as a key-on event (KON) or a key-off event (KOFF), a keycode (represented by 'KeyCode') and a velocity (represented by 'Velocity'). 'TWBUF' represents a truncate-weight buffer which stores four kinds of data representative of the key event (KeyEvent), keycode (KeyCode), velocity (Velocity) and a truncate channel (represented by 'Assign Ch.'), wherein the truncate channel is a tone-generation channel which is subjected to truncate process. The buffer TWBUF is provided to perform sync tone-generation in a truncate event. In the truncate event, at least one of tone-generation channels, all of which are used for sync tone-generation, is currently in the truncate process, so it is necessary to wait for completion of the truncate process in order to start the sync tone-generation. For this reason, the buffer TWBUF stores the truncate channel. The buffer SYNCBUF stores two kinds of data representative of a keycode (KeyCode) and a state of the keycode (represented by 'State'). The state of the keycode is classified into two states, i.e., 'READY' and 'WAIT'. In the READY state, preparation for tone-generation is completed. In the WAIT state, the preparation for the tone-generation has not been completed yet.

Figure 9:
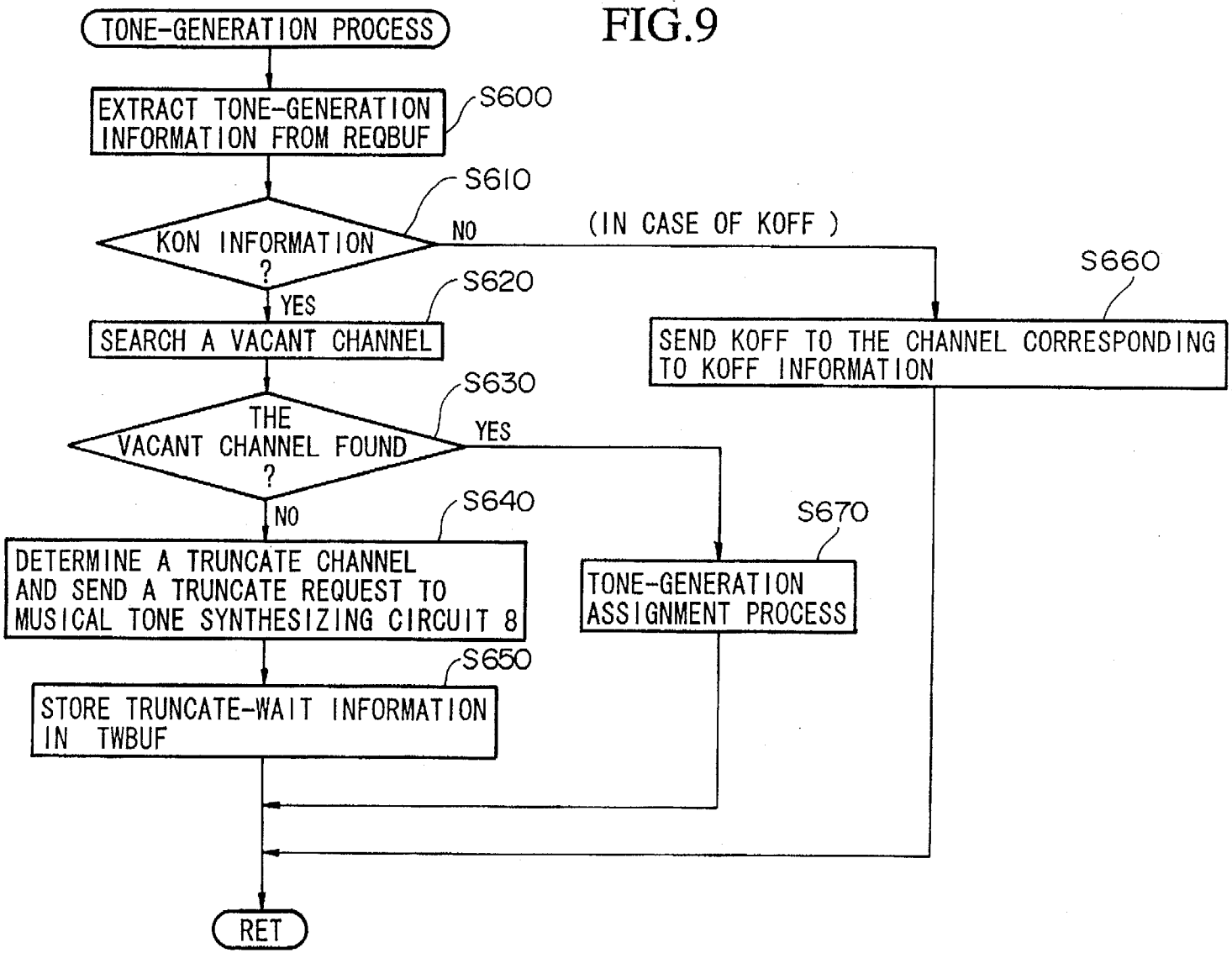
FIG. 9 is a flowchart showing tone-generation process.

FIG. 9 is a flowchart showing tone-generation process which is started when data are stored in the buffer REQBUF. In first step S600, tone-generation information is extracted from the buffer REQBUF. In step S610, decision is made as to whether the tone-generation information extracted is either KON information or KOFF information. If the KON information is detected, the CPU 3 proceeds to step S620 in which searching is performed to find out a vacant channel among the channels. If the vacant channel is found, the CPU 3 proceeds to step S670 through step S630. In the step S670, tone-generation assignment process is performed, so tone-generation task is assigned to the vacant channel.

If the step S630 determines that no vacant channel is found, the CPU 3 proceeds to step S640 in order to create a vacant channel. In the step S640, a tone-generation channel, which should be subjected to truncate process, i.e., a truncate channel, is determined; and then, a truncate request is sent to the musical tone synthesizing circuit 8.

The musical tone synthesizing circuit 8 receives information, representative of the truncate channel, and a truncate command signal at the interface 20 thereof. In such a truncate event, the target value (LEVEL) for the envelope is set at '0' and the inclination (RATE) of the envelope is set at a certain value representative of a smallest (or largest) inclination which does not cause occurrence of noises. When the level of the envelop is reduced to zero (or a certain threshold value), an interrupt process is performed by the musical tone synthesizing circuit 8 so as to report an end of the truncate process.

If the step S610 determines that the tone-generation information is the KOFF information, the CPU 3 proceeds to step S660. In the step S660, a key-off signal 'KOFF' is sent to a tone-generation channel which is now occupied in generating a musical tone which relates to a key-off event. After completion of the step S660, execution of the tone-generation process is ended.

As described before, when the vacant channel exists among the channels, the tone-generation assignment process of the step S670 is performed. A flowchart showing the tone-generation assignment process is shown by FIG. 10.

Figure 10:
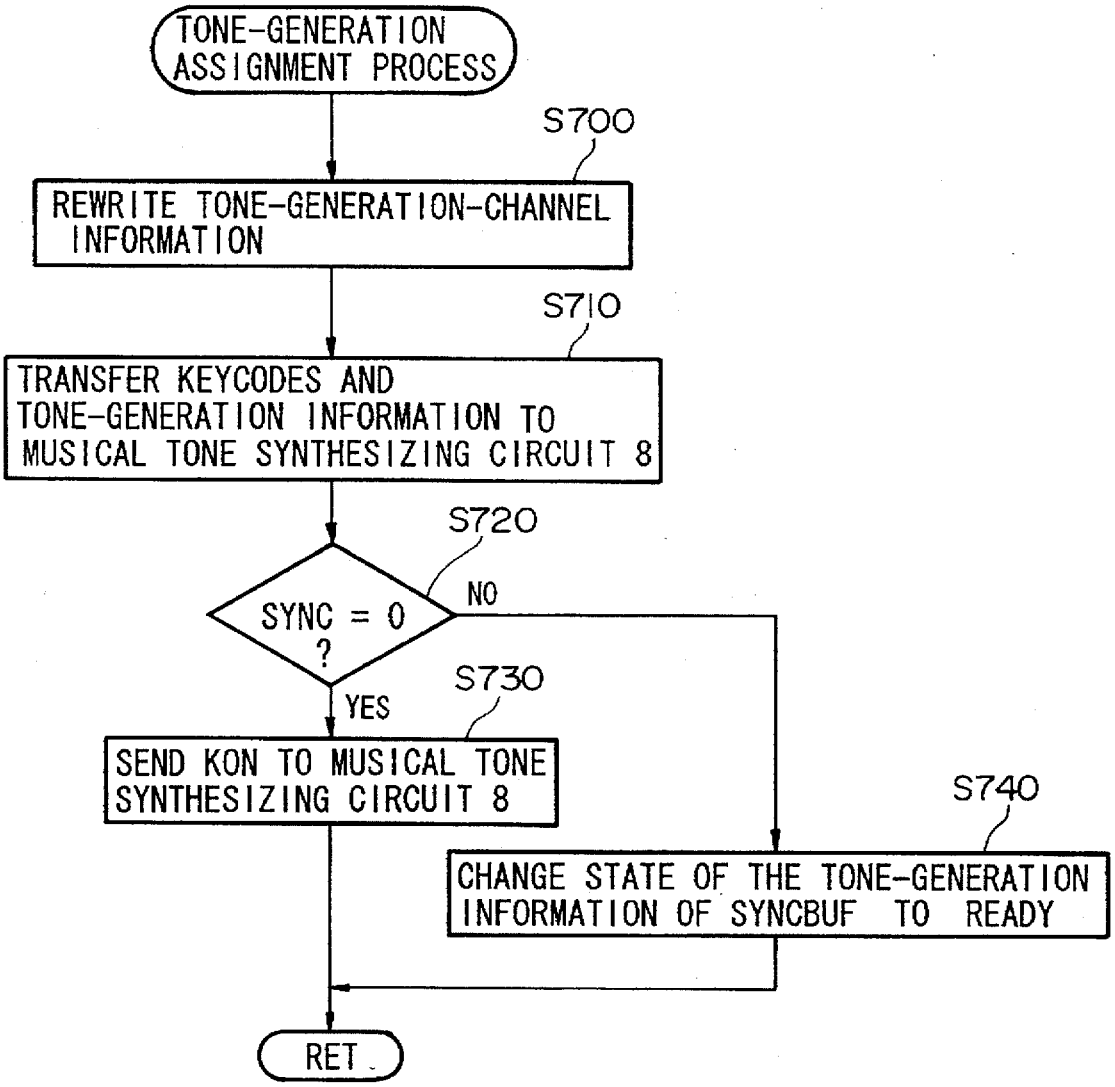
FIG. 10 is a flowchart showing tone-generation assignment process.

In first step S700 of FIG. 10, tone-generation-channel information, which is held by the CPU 3, is rewritten. The tone-generation-channel information rewritten contains information representative of a pitch of a musical tone generated and a timing of generating the musical tone as well as information representative of whether or not a key, which is depressed to generate the musical tone, has been already released. The tone-generation-channel information is used for assignment of a tone-generation channel and selection of a truncate channel. In step S710, data representative of a keycode and tone color information are transferred to a specific tone-generation channel of the musical tone synthesizing circuit 8. Thus, the data are written into the shift register SR1 of the double buffer shown in FIG. 3. At that moment, however, generation of a musical tone based on the data is not started. In step S720, decision is made as to whether or not the sync signal SYNC is equal to zero. If SYNC=0, sync-tone-generation control is not made, so the CPU 3 proceeds to step S730. In the step S730, KON information is sent to the musical tone synthesizing circuit 8. Then, execution of the tone-generation assignment process is ended.

Thus, the data of the shift register SR1 are written into the shift register SR2 in the double buffer, so the sound source 25 is instructed to start generation of a new musical tone. By the way, when the KON information is sent to the musical tone synthesizing circuit 8, data for all of the tone-generation channels will be rewritten. However, data, which are rewritten in the shift register SR1, merely relate to one tone-generation channel. Therefore, data for other tone-generation channels are not affected.

If the step S720 determines that the sync signal SYNC is not equal to zero, in other words, if the sync signal SYNC is equal to '1', the sync-tone-generation control should be performed. In that case, KON information is not transferred to the musical tone synthesizing circuit 8; and the CPU 3 proceeds to step S740. In the step S740, a keycode of the corresponding tone-generation information in the buffer SYNCBUF is changed in state from 'WAIT' to 'READY'. When all of keycodes are completely changed to the 'READY' state, the KON information is sent to the musical tone synthesizing circuit 8 in the step S100 of the main routine shown by FIG. 5.

Figure 11:
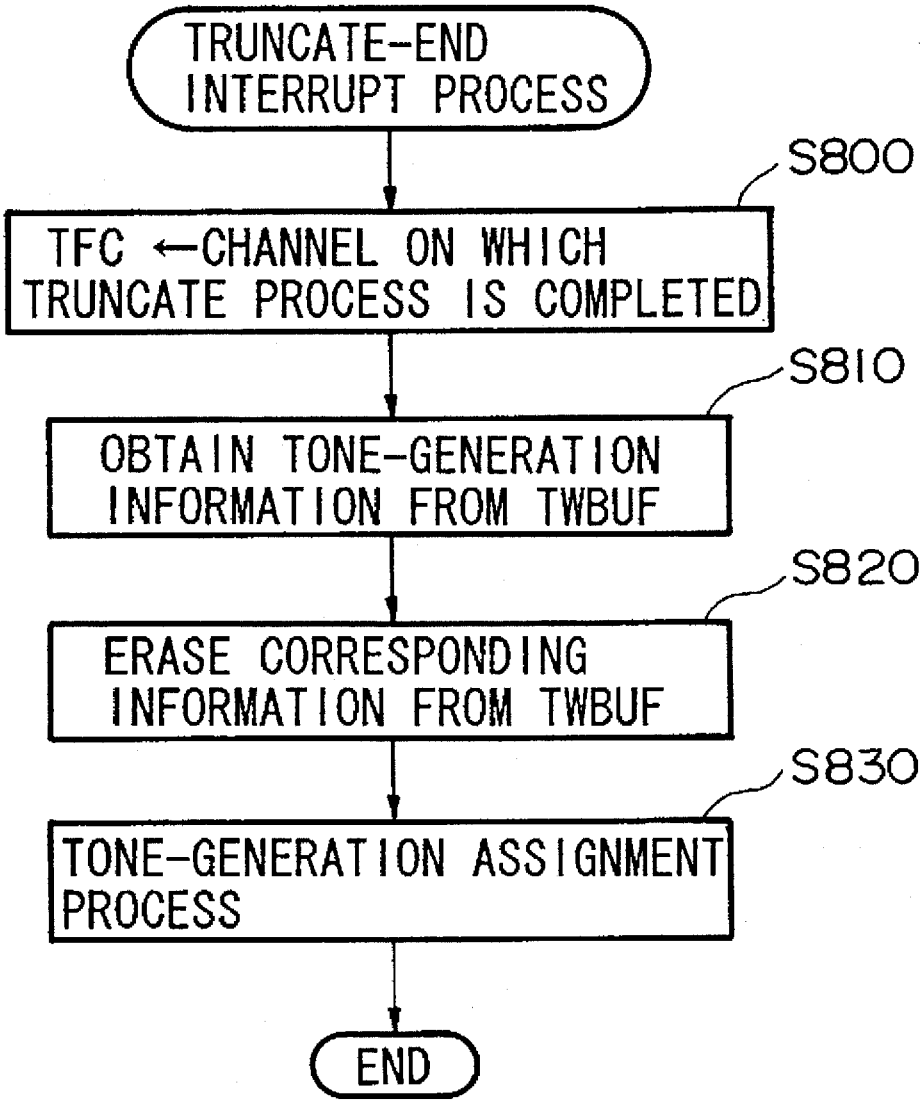
FIG. 11 is a flowchart showing truncate-end interrupt process.

When the truncate process, which is requested by the tone-generation process of FIG. 9 (see step S640), is completed by the musical tone synthesizing circuit 8, a truncate-end interrupt process shown by FIG. 11 is started.

In first step S800, a channel on which the truncate process is completed is represented by 'TFC'. In step S810, keycode and velocity corresponding to a musical tone, which should be generated by a channel on which truncate process is completed, can be obtained from information, in which a truncate channel (Assign Ch) coincides with the channel TFC, within information of the buffer TWBUF. Based on them, tone-generation assignment process is performed in step S830. Before that, step S820 is performed to erase information whose musical tone should be generated by the channel on which the truncate process is completed. In the step S830, the tone-generation assignment process, as shown by FIG. 10, is performed. After completion of the tone-generation assignment process, a state of the buffer SYNCBUF is changed to 'READY' when sync tone-generation is activated. After states for all of the tone-generation information are completely set in the 'READY' state, KON information is sent to the musical tone synthesizing circuit 8 when the CPU 3 proceeds to the step S100 of the main routine shown in FIG. 5. Thus, all of musical tones are generated simultaneously. In addition, the contents of the buffer SYNCBUF are cleared.

As described above, even if tone-generation requests are transferred to the musical tone synthesizing circuit at different timings, it is possible to accomplish 'strict' sync tone-generation by setting the electronic musical instrument in a standby state until receipt of a last tone-generation request. Further, the electronic musical instrument is set in a standby state to wait for completion of the truncate process, which requires relatively long time, so the sync tone-generation is secured.

The sound source 25 of the musical tone synthesizing circuit 8 is designed to synthesize musical tone data for multiple tone-generation channels at different channel timings based on time-division-multiplex system. Those musical tone data are accumulated when being subjected to digital-analog conversion by the digital-analog converter 26, so timings thereof are adjusted to coincide with a same timing. Therefore, corresponding musical tones are simultaneously generated by the sound system 27 at a completely same timing.

Figure 13:
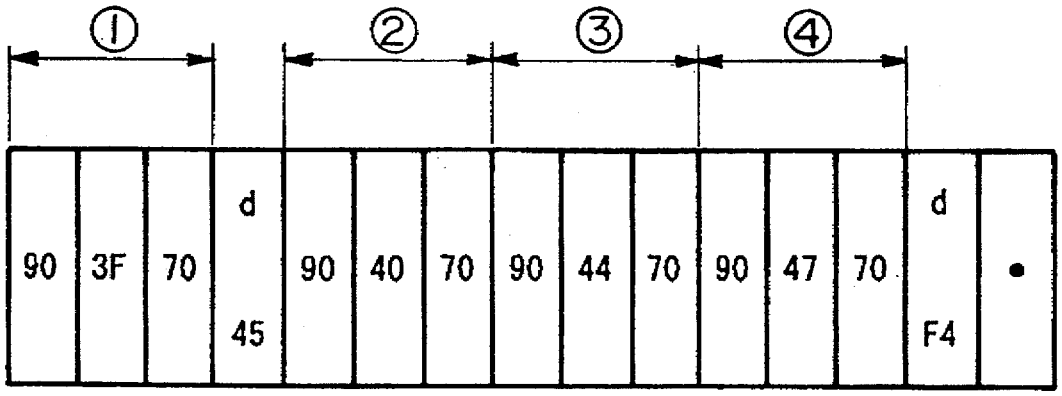
FIG. 13 shows a data format of sequence data.

Meanwhile, sequence data, whose format is shown in FIG. 13, are stored by a memory provided inside of the sequencer which acts as the automatic performance apparatus. The contents of the sequence data are regenerated by the sequencer and are transferred as the MIDI data as shown by FIGS. 2A and 2C. In FIG. 13, the sequence data contain data formats for four musical tones ① to ④ shown in FIGS. 2A and 2C. The sequencer sequentially reads out multiple data of the sequence data from the left of FIG. 13. Data of 'd45', which is arranged between the data formats of the musical tones ① and ②, is data representative of a duration between those musical tones. Thus, transfer of the musical tone ② is in a standby state during a period of time, corresponding to the duration, after transfer of the musical tone ①. There is provided no duration between the musical tones ② and ③ and between the musical tones ③ and ④. In other words, tone-generation information corresponding to those three musical tones ② to ④ should be subjected to sync tone-generation. When employing the aforementioned "running status function", it is possible to omit transfer of data '90' in the musical tones ③ and ④.

Figure 12:
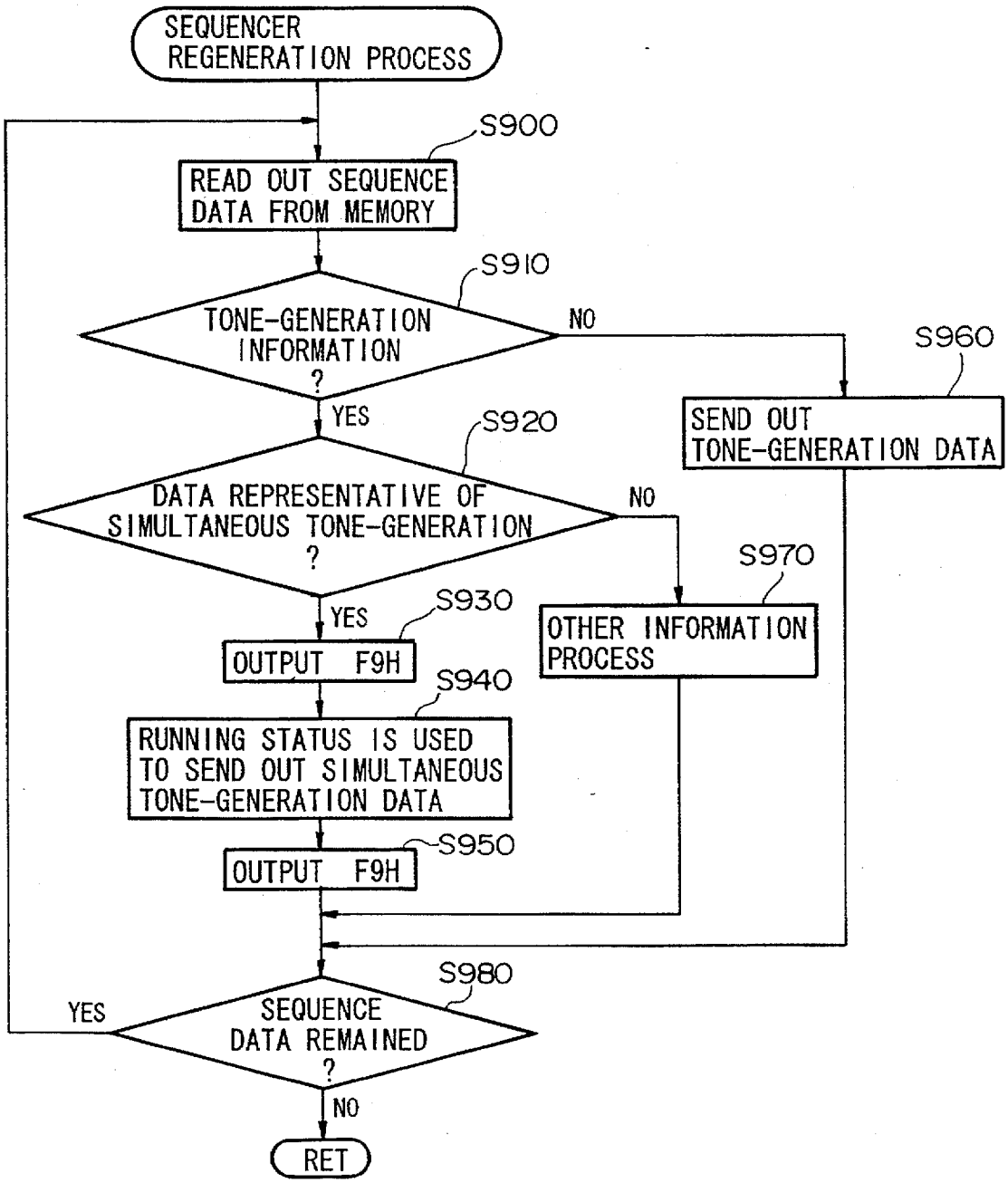
FIG. 12 is a flowchart showing sequencer regeneration process.

A flowchart showing sequencer regeneration process, which performs regeneration of the sequence data, is shown by FIG. 12. In first step S900, the sequence data are read out from the memory. In step S910, decision is made as to whether or not the sequence data read out are tone-generation information. If so, the CPU 3 proceeds to step S920 in which decision is made as to whether or not the tone-generation information regards data representative of musical tones which should be simultaneously generated. If no duration exists between tone-generation information previously read out and the tone-generation information currently read out so that they are judged as data representative of musical tones which should be generated simultaneously, the CPU 3 proceeds to step S930 in which a signal of 'F9H' is outputted. In step S940, the running status function is employed to send out sync tone-generation data with omitting a status byte (or status bytes). In step S950, a signal of 'F9H' is outputted. Thus, the aforementioned MIDI data, shown by FIG. 2C, are transferred.

In step S980, decision is made as to whether or not sequence data are remained in the memory without being regenerated. If so, the CPU 3 proceeds back to the step S900. Thus, the aforementioned steps regarding regeneration of the sequence data are repeated. If no sequence data are remained, execution of the sequencer regeneration process is ended.

If the step S910 determines that the sequence data read out are not tone-generation information, the CPU 3 proceeds to step S960 in which other information process is performed. Then, the CPU 3 proceeds directly to the step S980. Further, if the step S920 determines that data do not relate to sync tone-generation, the CPU 3 proceeds to step S970 in which the data (i.e., tone-generation data) are sent out.

Incidentally, it is unnecessary to use a special delimiter code (i.e., signal of 'F9H') as delimiter for the sync tone-generation. So, it is possible to use a set of tone-generation information which are transferred using the running status function. In this case, a start point for the sync tone-generation is defined by a start of a running status, while an end point for the sync tone-generation is acknowledged when no data are received for a certain time or more which is determined in advance. Since first method using the delimiter code is superior to second method using the running status in terms of a time response, the first method is preferable.

Moreover, it is possible to modify the electronic musical instrument in such a way that time required for a truncate process is neglected. Herein, channel assignment is performed on multiple musical tones on which sync tone-generation is acknowledged; and sync tone-generation information is sent out after completion of the channel assignment. In that case, if a truncate process occurs on a certain channel, a tone-generation timing of the certain channel should be shifted slightly from a sync tone-generation timing. However, possibility that such an event occurs is relatively low. In normal situation where execution of truncate process does not occur, it is possible to start generation of musical tones faster as compared to situation where execution of truncate process occurs.

In the aforementioned description, we explain that synchronized control for key-off timings is not so effective. However, in case of special musical tones which may cause to occur key-off noises at key-off timings, the synchronized control for the key-off timings can be employed as well as for the key-on timings. In short, the synchronized control for the key-off timings is effective for some systems in which key-off timings can be clearly distinguished from each other in a sense of hearing.

The apparatus of the present embodiment may be interpreted as one which may eternally wait for a moment at which all conditions for the sync tone-generation are satisfied. The present embodiment can be modified in such a way that generation of musical tones, which currently meet the conditions for the sync tone-generation, are forced to be started. Such a modification can cope with a first situation where 'F9H' is transmitted by mistake, a second situation where 'F9H', indicative of completion of sync tone-generation, is missed during transfer of MIDI signals and a third situation where a number of the tone-generation channels is relatively large so that relatively long time is required for the truncate process, because the modification can offer an effect in which generation of the musical tones is started without causing a large delay of time.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within meets and bounds of the claims, or equivalence of such meets and bounds are therefore intended to be embraced by the claims.

What is claimed is:

1. An electronic musical instrument comprising:

providing means for providing a plurality of tone-generation data which are sequentially transmitted in a time-series manner;

distinguishing means for distinguishing specific tone-generation data, representative of musical tones which should be generated simultaneously, from the plurality of tone-generation data;

decision means for making decision as to whether or not a ready state is established, wherein the ready state indicates completion of preparation for sync generation of the musical tones represented by the specific tone-generation data; and means for starting the generation of the musical tones when the decision means makes decision that the ready state is established.

2. An electronic musical instrument, having an automatic performance function, comprising:

reading means for reading out a plurality of tone-generation data from memory means;

distinguishing means for distinguishing specific tone-generation data, representative of musical tones which should be simultaneously generated, from the plurality of tone-generation data which are read by the reading means; and means for providing indicator information, which indicates existence of the specific tone-generation data which are distinguished from the plurality of tone-generation data, so that the specific tone-generation data are transmitted together with the indicator information, whereby the musical tones of the specific tone-generation data are generated simultaneously.

3. An electronic musical instrument comprising:

means for providing sequence data representative of a sequence of musical tones to be generated;

distinguishing means for distinguishing specific data, representative of musical tones which should be generated simultaneously, from the sequence data;

indicator providing means for providing indicator data when the specific data are distinguished by the distinguishing means;

transmitting means for transmitting the specific data together with the indicator data; and tone-generation means for simultaneously generating the musical tones based on the specific data upon receipt of the indicator data.

4. An electronic musical instrument comprising:

sequencer means for providing automatic performance data in a MIDI-standard form, wherein the automatic performance data contain a plurality of MIDI data and indicator data;

mode detecting means for detecting a sync-tone-generation mode based on the indicator data;

determining means for determining a sync-tone-generation timing which comes after a duration of the sync-tone-generation mode; and sync-tone-generation means for generating musical tones in a synchronized manner, represented by specific MIDI data which correspond to the sync-tone-generation mode, at the sync-tone-generation timing.

5. An electronic musical instrument according to claim 4 wherein each MIDI data, which represents one musical tone to be generated, consists of one status byte and two data bytes, while the specific MIDI data, which correspond to the sync-tone-generation mode, are transmitted with omitting a status byte in accordance with a running status function.

* * * * *